US007236097B1

(12) United States Patent
Cunningham

(10) Patent No.: US 7,236,097 B1
(45) Date of Patent: Jun. 26, 2007

(54) HAND WASHING ALERT SYSTEM

(76) Inventor: Edward L. Cunningham, 620 Lisa Pl., North Brunswick, NJ (US) 08902

( * ) Notice: Subject to any disclaimer, the term of this patent is extended or adjusted under 35 U.S.C. 154(b) by 288 days.

(21) Appl. No.: 11/112,556

(22) Filed: Apr. 25, 2005

(51) Int. Cl.
*G08B 25/08* (2006.01)

(52) U.S. Cl. ..... 340/692; 340/309.7; 340/567; 340/573.1; 340/628; 340/693.2

(58) Field of Classification Search ..... 340/573.1, 340/567, 555, 692, 691.6, 309.7, 529, 628, 340/693.2
See application file for complete search history.

(56) References Cited

U.S. PATENT DOCUMENTS 4,896,144 A 1/1990 Bogstad
5,202,666 A 4/1993 Knippscheer
D363,804 S 10/1995 Parker et al.
6,028,520 A * 2/2000 Maehre ..... 340/692
6,133,843 A 10/2000 Davidson
6,426,701 B1 7/2002 Levy et al.
6,523,193 B2 2/2003 Saraya
2003/0030562 A1* 2/2003 Lane et al. ..... 340/573.1
2004/0001009 A1* 1/2004 Winings et al. ..... 340/870.16

* cited by examiner

*Primary Examiner*—Thomas Mullen

(57) ABSTRACT

A hand washing alert system includes a housing that is mounted on a wall above a doorway. A motion detector is mounted on the housing and is adapted for detecting motion through the doorway. A processor is mounted in the housing and is electrically coupled to the motion detector. A sound emitter is mounted on the housing and is electrically coupled to the processor. An electronic memory storage is mounted in the housing and is electrically coupled to the processor. A message indicating that a person should wash their hands is recorded on the electronic memory storage. The processor is adapted for playing the message on the sound emitter between 20 seconds and 40 seconds after the motion detector detects motion.

4 Claims, 2 Drawing Sheets

HAND WASHING ALERT SYSTEM

BACKGROUND OF THE INVENTION

1. Field of the Invention

The present invention relates to alert devices and more particularly pertains to a new alert device for alerting a person in a restroom that they should wash their hands before leaving the restroom.

2. Description of the Prior Art

The use of alert devices is known in the prior art. U.S. Pat. No. 4,896,144 describes a device for warning a person to wash their hands either before or after leaving a restroom facility. Another type of alert device is U.S. Pat. No. 5,202,666 which comprises a system for determining if a person has washed their hands before leaving a washroom. Yet another such device is found in U.S. Pat. No. 6,426,701 which again includes a device that monitors whether a person has properly washed their hands after using a restroom.

While these devices fulfill their respective, particular objectives and requirements, the need remains for a device which suggests to a person that they should wash their hands after they have been in a restroom for a selected amount of time. The device should includes a motion detector to detect when a person has entered a restroom and may further include emergency lighting and a smoke detector.

SUMMARY OF THE INVENTION

The present invention meets the needs presented above by generally comprising a housing that is mounted on a wall above a doorway. A motion detector is mounted on the housing and is adapted for detecting motion through the doorway. A processor is mounted in the housing and is electrically coupled to the motion detector. A sound emitter is mounted on the housing and is electrically coupled to the processor. An electronic memory storage is mounted in the housing and is electrically coupled to the processor. A message indicating that a person should wash their hands is recorded on the electronic memory storage. The processor is adapted for playing the message on the sound emitter between 20 seconds and 40 seconds after the motion detector detects motion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
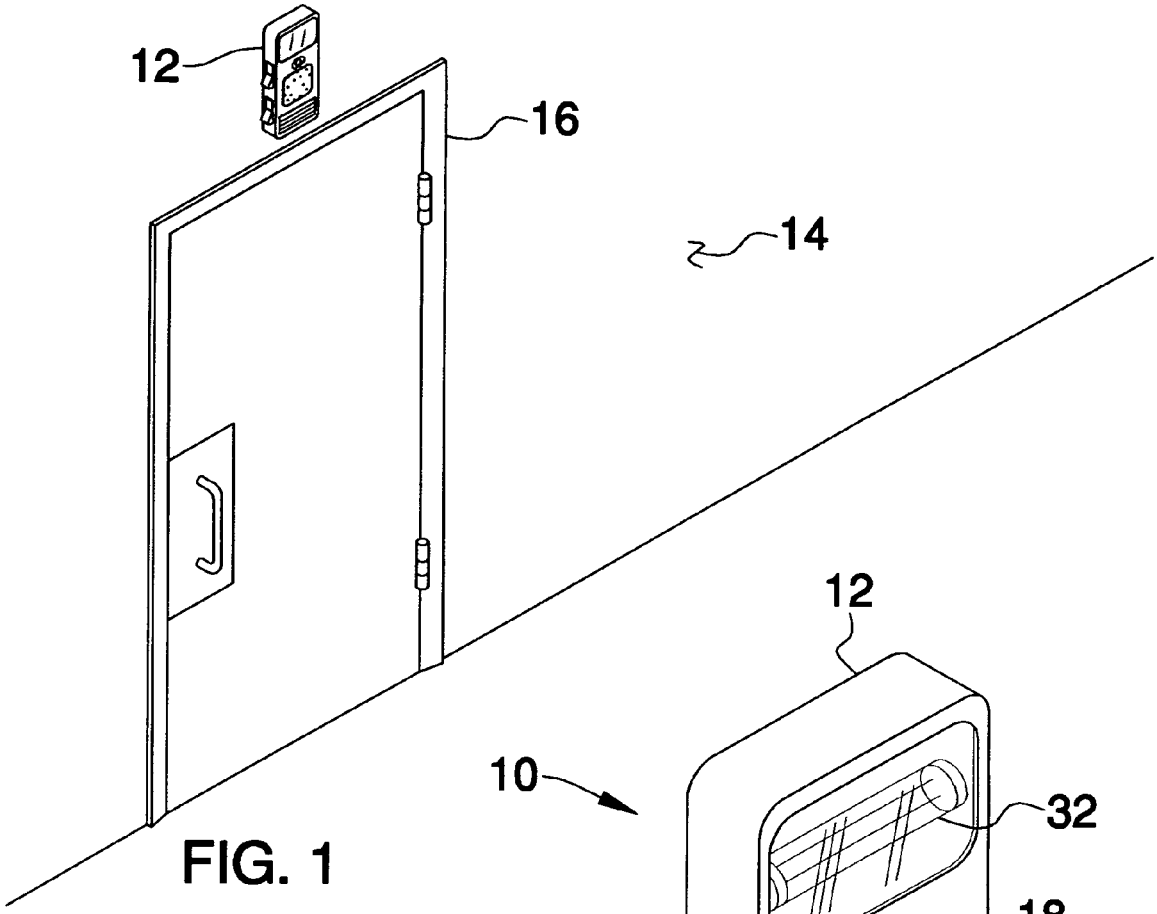
FIG. 1 is a perspective in-use view of a hand washing alert system according to the present invention.
Figure 2:
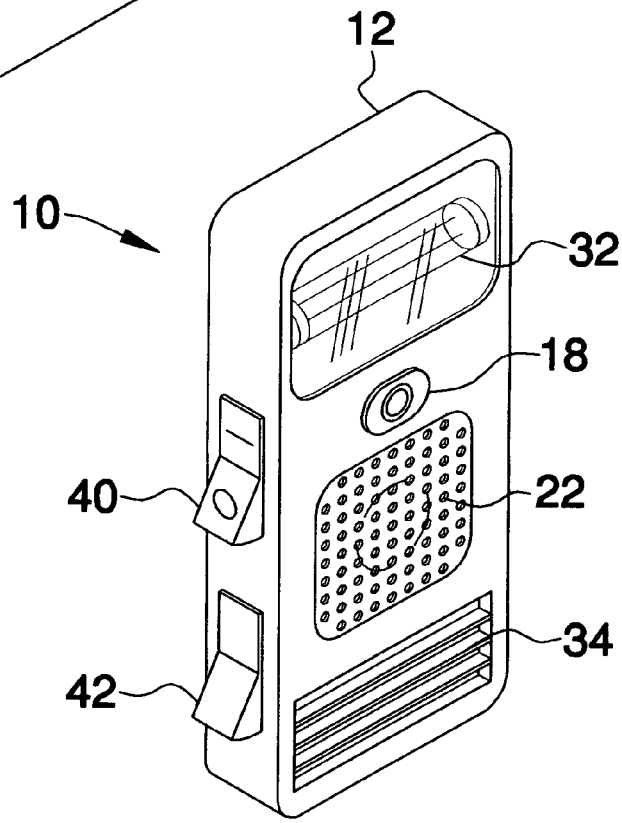
FIG. 2 is a perspective view of the present invention.
Figure 3:
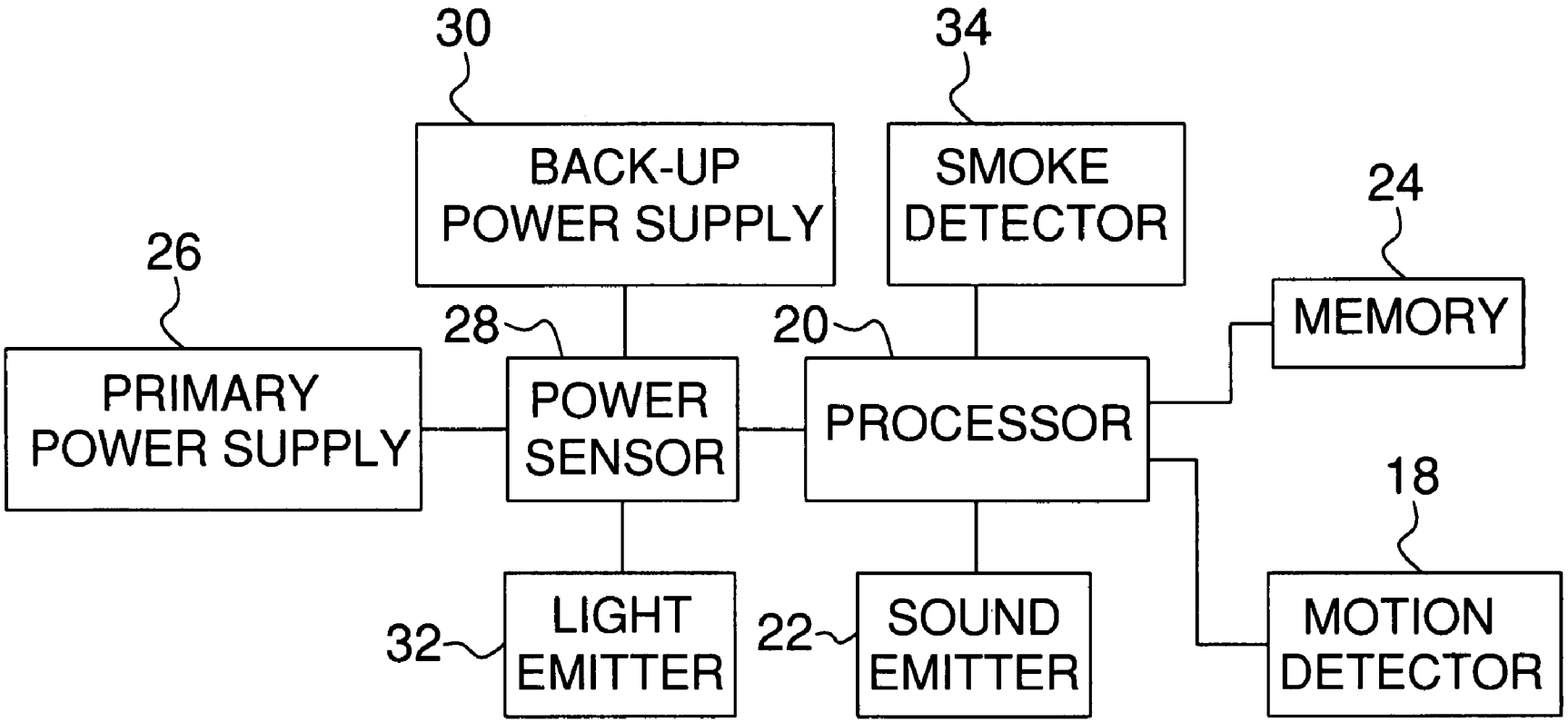
FIG. 3 is a schematic view of the present invention.

With reference now to the drawings, and in particular to FIGS. 1 through 3 thereof, a new alert device embodying the principles and concepts of the present invention and generally designated by the reference numeral 10 will be described.

As best illustrated in FIGS. 1 through 3, the hand washing alert system 10 generally comprises a housing 12 that is mounted on a wall 14 above a doorway 16. In particular, the wall 14 is an inner wall surface of a restroom.

A motion detector 18 is mounted on the housing 12 and is adapted for detecting motion through the doorway 16. The motion detector 18 is conventional and preferably includes an infrared motion detector. A processor 20 is mounted in the housing 12 and is electrically coupled to the motion detector 18. A sound emitter 22 is mounted on the housing 12 and is electrically coupled to the processor 20. An electronic memory storage 24 mounted in the housing 12 is electrically coupled to the processor 20. A message indicating that a person should wash their hands is recorded on the electronic memory storage 24. The processor 20 is adapted for playing the message on the sound emitter 22 after a selected amount of time. The selected amount of time is preferably between 20 seconds and 40 seconds after the motion detector detects motion. A primary power supply 26 is electrically coupled to the processor 20. The primary power supply 26 preferably consists of hardwiring an electrical supply to the processor 20.

A power sensor 28 is mounted in the housing 12 and is electrically coupled to the primary power supply 26. The power sensor 28 is adapted for detecting an interruption in electrical power from the primary power supply 26. A backup power supply 30 is mounted in the housing 12 and is electrically coupled to the power sensor 28. The backup power supply 28 is preferable a battery. A light emitter 32 is mounted on the housing 12 and is electrically coupled to the power sensor 28. The power sensor 28 is adapted for turning the light emitter 32 on when an interruption in electrical power is detected.

A smoke detector 34 is mounted on the housing 12 and is electrically coupled to the processor 20. The processor 20 sounds an alarm signal on the sound emitter 22 when the smoke detector 34 detects smoke.

In use, the housing 12 is mounted on the wall 14 above a restroom door 16. The motion detector 18 detects when someone walks into a restroom and provides enough time for a person to begin to use the restroom. The processor 20 then sends the message programmed on the memory storage 24 to remind a person that they should wash their hands when they are finished with the restroom. The reminder will make a person contemplate washing their hands and will therefore lead to a higher rate of hand washing. The light emitter 32 will be used as an emergency light source in case of a power failure to the restroom lights and the smoke detector 34 functions in a conventional manner. A power actuator 40 and a volume control 42 may also be electronically coupled to the processor 20.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hand washing alert system comprising:

a housing being mounted on a wall above a doorway;

a motion detector being mounted on said housing and being adapted for detecting motion through the doorway;

a processor being mounted in said housing and being electrically coupled to said motion detector;

a sound emitter being mounted on said housing and being electrically coupled to said processor; and an electronic memory storage being mounted in said housing and being electrically coupled to said processor, a message indicating that a person should wash their hands being recorded on said electronic memory storage, said processor being adapted for playing said message on said sound emitter between 20 seconds and 40 seconds after said motion detector detects motion.

2. The system according to claim 1, further including:

a primary power supply being electrically coupled to said processor;

a power sensor being mounted in said housing and being electrically coupled to said primary power supply and being adapted for detecting an interruption in electrical power from said primary power supply;

a backup power supply being mounted in said housing and being electrically coupled to said power sensor; and a light emitter being mounted on said housing and being electrically coupled to said power sensor, said power sensor being adapted for turning said light emitter on when an interruption in electrical power is detected.

3. The system according to claim 1, further including a smoke detector being mounted on said housing and being electrically coupled said processor, said processor sounding an alarm signal on said sound emitter when said smoke detector detects smoke.

4. A hand washing alert system comprising:

a housing being mounted on a wall above a doorway;

a motion detector being mounted on said housing and being adapted for detecting motion through the doorway;

a processor being mounted in said housing and being electrically coupled to said motion detector;

a sound emitter being mounted on said housing and being electrically coupled to said processor;

an electronic memory storage being mounted in said housing and being electrically coupled to said processor, a message indicating that a person should wash their hands being recorded on said electronic memory storage, said processor being adapted for playing said message on said sound emitter between 20 seconds and 40 seconds after said motion detector detects motion;

a primary power supply being electrically coupled to said processor;

a power sensor being mounted in said housing and being electrically coupled to said primary power supply and being adapted for detecting an interruption in electrical power from said primary power supply;

a backup power supply being mounted in said housing and being electrically coupled to said power sensor;

a light emitter being mounted on said housing and being electrically coupled to said power sensor, said power sensor being adapted for turning said light emitter on when an interruption in electrical power is detected; and a smoke detector being mounted on said housing and being electrically coupled to said processor, said processor sounding an alarm signal on said sound emitter when said smoke detector detects smoke.

* * * * *